US005988042A

United States Patent [19]

Lamle

[11] Patent Number: 5,988,042

[45] Date of Patent: Nov. 23, 1999

[54] RODLESS CYLINDER WITH INTERNAL BEARINGS

[75] Inventor: Michael E. Lamle, Syracuse, Ind.

[73] Assignee: PHD, Inc., Fort Wayne, Ind.

[21] Appl. No.: 08/957,061

[22] Filed: Oct. 24, 1997

[51] Int. Cl.[6] ..... F01B 29/00

[52] U.S. Cl. ..... 92/88; 92/140

[58] Field of Search ..... 92/88, 247, 140

[56] References Cited

U.S. PATENT DOCUMENTS

| | | | |
|---|---|---|---|
| Re. 33,637 | 7/1991 | Hoglund . | |
| Re. 34,049 | 9/1992 | Taki et al. . | |
| 1,379,041 | 5/1921 | Pulliam . | |
| 1,469,087 | 9/1923 | Hewitt . | |
| 2,410,405 | 11/1946 | Cornelius . | |
| 3,023,739 | 3/1962 | Dickson, Jr. et al. . | |
| 3,128,468 | 4/1964 | Bade . | |
| 3,199,289 | 8/1965 | Ramsay et al. . | |
| 3,205,787 | 9/1965 | Volkmann . | |
| 3,893,378 | 7/1975 | Hewitt | 92/88 |
| 4,137,827 | 2/1979 | Hewitt | 92/88 |
| 4,373,427 | 2/1983 | Garlapaty . | |
| 4,419,924 | 12/1983 | Peter et al. | 92/88 |
| 4,519,297 | 5/1985 | Lipinski . | |
| 4,545,290 | 10/1985 | Lieberman . | |
| 4,555,980 | 12/1985 | Hoglund . | |
| 4,664,020 | 5/1987 | Kaiser . | |
| 4,685,383 | 8/1987 | Ruchser . | |
| 4,724,744 | 2/1988 | Rosengren . | |
| 4,733,604 | 3/1988 | Lipinski . | |
| 4,819,546 | 4/1989 | Ernst et al. . | |
| 4,829,881 | 5/1989 | Taki et al. . | |
| 4,852,465 | 8/1989 | Rosengren . | |
| 4,856,415 | 8/1989 | Noda . | |
| 4,881,454 | 11/1989 | Granbom . | |
| 4,891,908 | 1/1990 | Aquilina . | |
| 4,960,037 | 10/1990 | Granbom . | |
| 4,991,494 | 2/1991 | Migliori . | |
| 4,998,459 | 3/1991 | Blatt . | |
| 5,111,913 | 5/1992 | Granbom . | |
| 5,138,935 | 8/1992 | Granbom . | |
| 5,159,814 | 11/1992 | Jakobhsson . | |
| 5,207,145 | 5/1993 | Kemner . | |
| 5,224,413 | 7/1993 | Herner . | |
| 5,241,897 | 9/1993 | Drittel . | |
| 5,245,912 | 9/1993 | Muller et al. . | |
| 5,277,101 | 1/1994 | Matsuki et al. . | |
| 5,279,207 | 1/1994 | Takada et al. . | |
| 5,303,638 | 4/1994 | Green . | |
| 5,311,810 | 5/1994 | Takada et al. . | |
| 5,317,957 | 6/1994 | Miyamoto . | |
| 5,335,583 | 8/1994 | Kaneko et al. . | |
| 5,353,690 | 10/1994 | Shin . | |
| 5,467,685 | 11/1995 | Hubl . | |
| 5,473,971 | 12/1995 | Takeuchi et al. . | |
| 5,483,868 | 1/1996 | Green . | |
| 5,531,151 | 7/1996 | Matsui . | |
| 5,537,912 | 7/1996 | Miyamoto et al. . | |
| 5,555,789 | 9/1996 | Rosengren et al. . | |
| 5,606,903 | 3/1997 | Drittel . | |
| 5,619,899 | 4/1997 | Asai et al. . | |

FOREIGN PATENT DOCUMENTS

| | | |
|---|---|---|
| 0 147 803 | 7/1985 | European Pat. Off. . |
| 44 13 512 | 10/1995 | Germany . |
| 2 002 088 | 2/1979 | United Kingdom . |
| 2 163 499 | 2/1986 | United Kingdom . |

*Primary Examiner*—Thomas E. Denion
*Attorney, Agent, or Firm*—Barnes & Thornburg

[57] ABSTRACT

Internal bearings for a rodless piston assembly. The internal bearings are seated on inclined rail structures of a transmission bracket. Force applied to the internal bearings causes them to slide up the inclined rail structures and press against the inner surface of the rodless piston bore. As a result, a radially inward force is applied to the transmission bracket. This radially inward force is transmitted to a saddle and external bearing assembly. The internal bearings thus hold the saddle against the outer surface of the rodless piston cylinder. Piston elements for rodless piston assemblies are movably coupled to the transmission brackets so that the piston elements float with respect to the transmission bracket. The floating piston elements can self-align with the rodless piston bore.

25 Claims, 9 Drawing Sheets

RODLESS CYLINDER WITH INTERNAL BEARINGS

TECHNICAL FIELD

The present invention relates to a piston-cylinder structure. More particularly, the present invention relates to rodless cylinder assemblies and improvements thereto.

BACKGROUND ART

A typical rodless cylinder assembly includes an elongate cylinder having an axially extending slot therein and a piston assembly which moves reciprocally within the elongated cylinder under fluid pressure. The assembly is "rodless" in that rather than including a piston rod which is joined to a piston, the piston assembly is coupled to a motion transmitting element which extends through the slot. The motion transmitting element is coupled externally to a carriage or saddle which reciprocates with the piston assembly and to which a workpiece support, tool, tool support, etc. can be mounted or secured.

The axially extending slot is sealed by means of a sealing strip or band which is pressed against the axially extending slot by internal fluid pressures. The sealing strip or band is pulled away from the axially extending slot at the center of the piston assembly whereat the motion transmitting element extends through the slot.

Because of the complexity of the components of rodless cylinder assemblies and particularly the interaction and cooperation of various component elements, there are many features of rodless cylinder assemblies which have been the focus of improvement over the years. Improvements for rodless cylinder assemblies have focused on such elements as the sealing strip or band structures, the carriage assemblies, carriage guide means, piston brake assemblies, etc.

The present invention is directed to improvements to rodless cylinder assemblies which have not been proposed or considered here-to-date.

DISCLOSURE OF THE INVENTION

In addition to other features of the present invention which will become apparent as the description thereof proceeds, the present invention provides a piston assembly for a rodless cylinder which includes:

- a transmission bracket having a pair of elongate side members, the pair of elongate side members including inclined surfaces; and
- internal bearing members which rest on the inclined surfaces of the elongate side members so as to freely slide thereon.

The present invention further provides a piston assembly for a rodless cylinder which includes:

- a transmission bracket having a central axis and opposite end portions; and
- a pair of piston elements movable coupled to the end portions of the transmission bracket, whereby relative axial alignment of the piston elements can vary with respect to the central axis of the transmission bracket.

The present invention also provides a rodless piston assembly which includes:

- an elongate piston cylinder having an axis, a slot formed in a first side thereof and an internal bore;
- a transmission bracket which is positioned in the internal bore of the elongate piston cylinder and includes a mounting bracket that extends through the slot;

- internal bearing members which are positioned in the internal bore of the elongate piston cylinder and operably coupled to the transmission bracket so as to exert a radial force on the mounting bracket.

The present invention further provides method of coupling a saddle to a rodless cylinder assembly which involves:

- providing a rodless cylinder which includes:
  - an elongate piston cylinder having an axis, a longitudinal slot formed in a first side thereof and an internal bore; and
  - a transmission bracket positioned in the internal bore of the elongate piston cylinder and including a mounting bracket that extends through the slot;
- positioning an internal bearing member in the internal bore of the elongate piston cylinder;
- operably coupling the internal bearing to the transmission bracket so that radial forces are exerted on the mounting bracket when the internal bearing moves axially with respect to the transmission bracket; and
- coupling a saddle to the mounting bracket.

BRIEF DESCRIPTION OF DRAWINGS

Features and characteristics of the present invention will be described hereafter with reference to the attached drawings which are given as non-limiting examples, in which.

BEST MODE FOR CARRYING OUT THE INVENTION

The present invention is directed to rodless cylinder assemblies which have numerous features. According to one embodiment, the rodless cylinders of the present invention include internal bearing members which apply a downward or radially inward force to a transmission bracket and saddle coupled thereto. This downward or radially inward force is used to maintain the radial position of the saddle or carriage and an external bearing assembly which are attached to the transmission bracket. The internal bearing members eliminate the need for the type of external structural elements which are sometimes used to maintain the radial position of saddles or carriages.

The internal bearing members of the present invention can be used in conjunction with a bearing assembly that is provided with side bearing surfaces, and thereby used to resist the tendency of the slot to widen under due to the fluid pressure within the cylinder.

The manner in which the piston elements are coupled to the transmission bracket allows the piston elements to "float" within the cylinder bore. That is, the piston elements are movable coupled to the transmission bracket so that they are allowed to self-adjust into alignment with the internal bore of the piston cylinder. The piston elements are coupled to the transmission bracket in such a manner that they are allowed to move radially or "float" with respect to the central axis of cylindrical bore of the piston assembly, but are restricted from longitudinal movement.

The manner in which the piston elements are coupled to the transmission bracket so that they "float" was developed to be used in conjunction with the internal bearing members of the present invention. Nevertheless, the "floating" piston elements of the present invention can be used in conjunction with other rodless piston assemblies which do not use the internal bearings of the present invention. The "floating" piston elements would function to self-align with the bore in any rodless piston assembly.

The use of the internal bearing members of the present invention allows for automatic adjustment of the external bearing assembly due to the manner in which the internal bearing members cooperate with the transmission bracket and the inner surface of the cylindrical bore of the piston assembly. That is, as the lower surfaces of the bearing assembly wear, the internal bearing members merely "slide" further up inclined surfaces of the transmission bracket.

Figure 1:
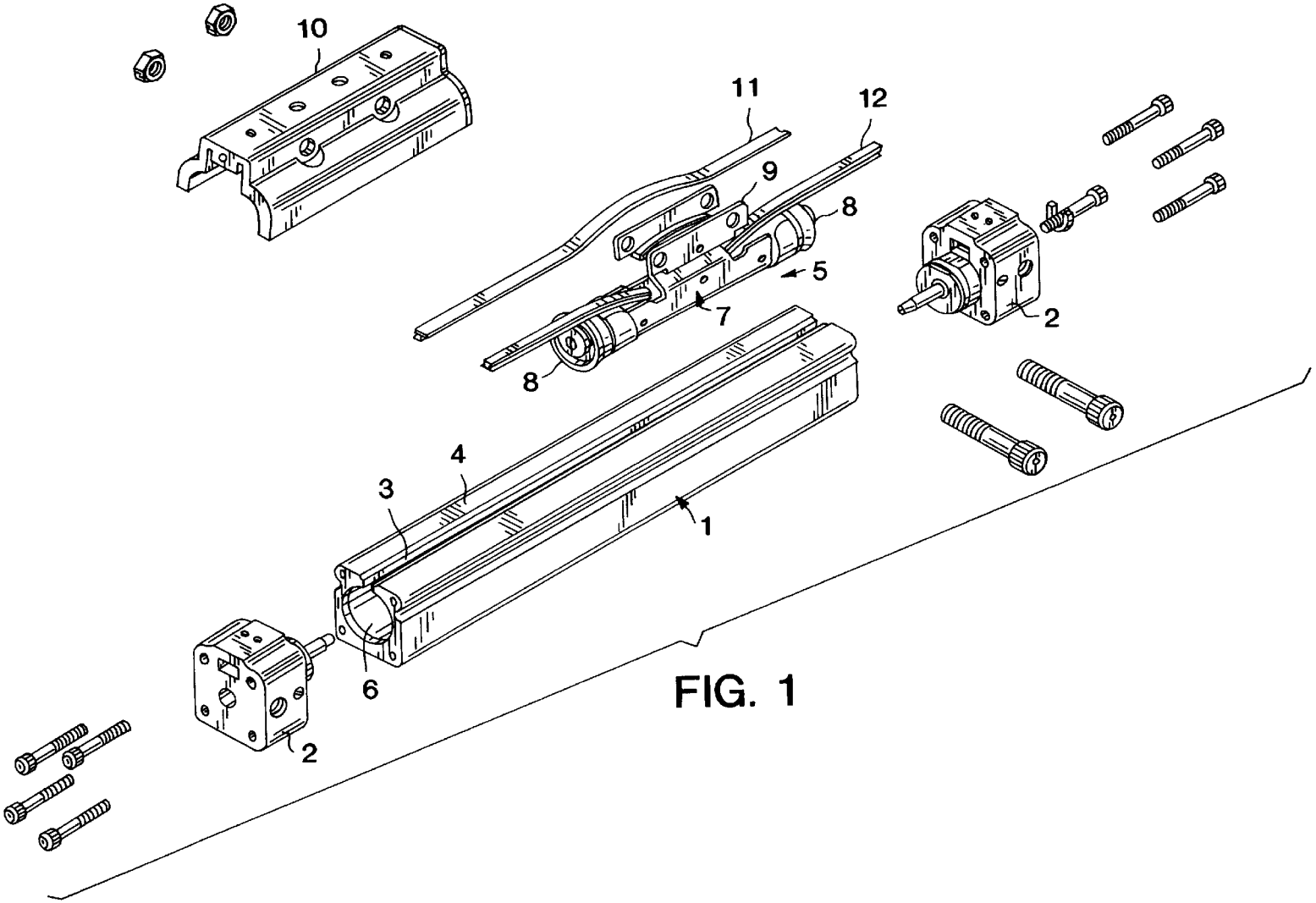
FIG. 1 is an exploded perspective view of a conventional rodless cylinder assembly which depicts the basic elements of a rodless cylinder.

FIG. 1 is an exploded perspective view of a conventional rodless cylinder assembly which depicts the basic elements of a rodless cylinder. As depicted, the rodless cylinder assembly includes an elongate cylinder assembly 1 having end members 2, a slot 3 formed in one elongate surface 4 thereof, and a piston assembly 5 which is positioned within a cylindrical bore 6 of the elongate cylinder assembly 1. The piston assembly 5 includes a piston bracket 7 having piston end portions 8 and a structure 9 which can extend through slot 3 and connect to a saddle assembly 10. The rodless piston assembly of FIG. 1 also includes upper and lower sealing members 11 and 12 which respectively seal slot 3 externally and internally.

Figure 2:
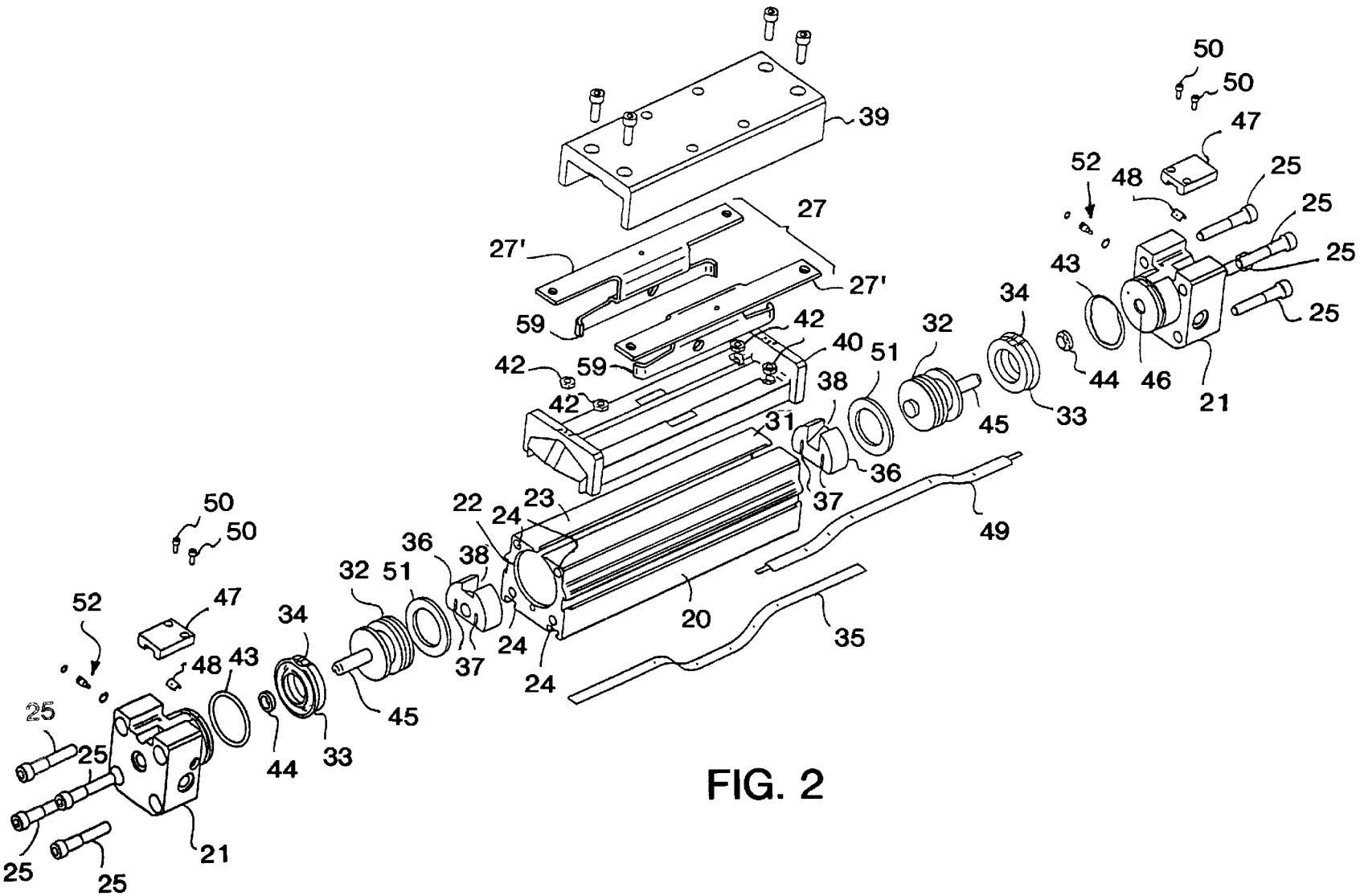
FIG. 2 is an exploded perspective view of a rodless cylinder assembly according to one embodiment of the present invention.

FIG. 2 is an exploded perspective view of a rodless cylinder assembly according to one embodiment of the present invention. The rodless cylinder assembly includes a cylinder assembly which comprises an elongate cylinder body 20 and end cap or head assemblies 21 which seal the elongate cylinder body 20 at opposite ends. The elongate cylinder body 20 includes a cylindrical bore 22 and a slot 23 in one of the side walls which can extend along the length thereof. The ends of the elongate cylinder body 20 are provided with threaded bores 24 which receive threaded members, e.g. bolts 25 that are used to secure the head assemblies 21 to the elongate cylinder body 20.

Figure 3:
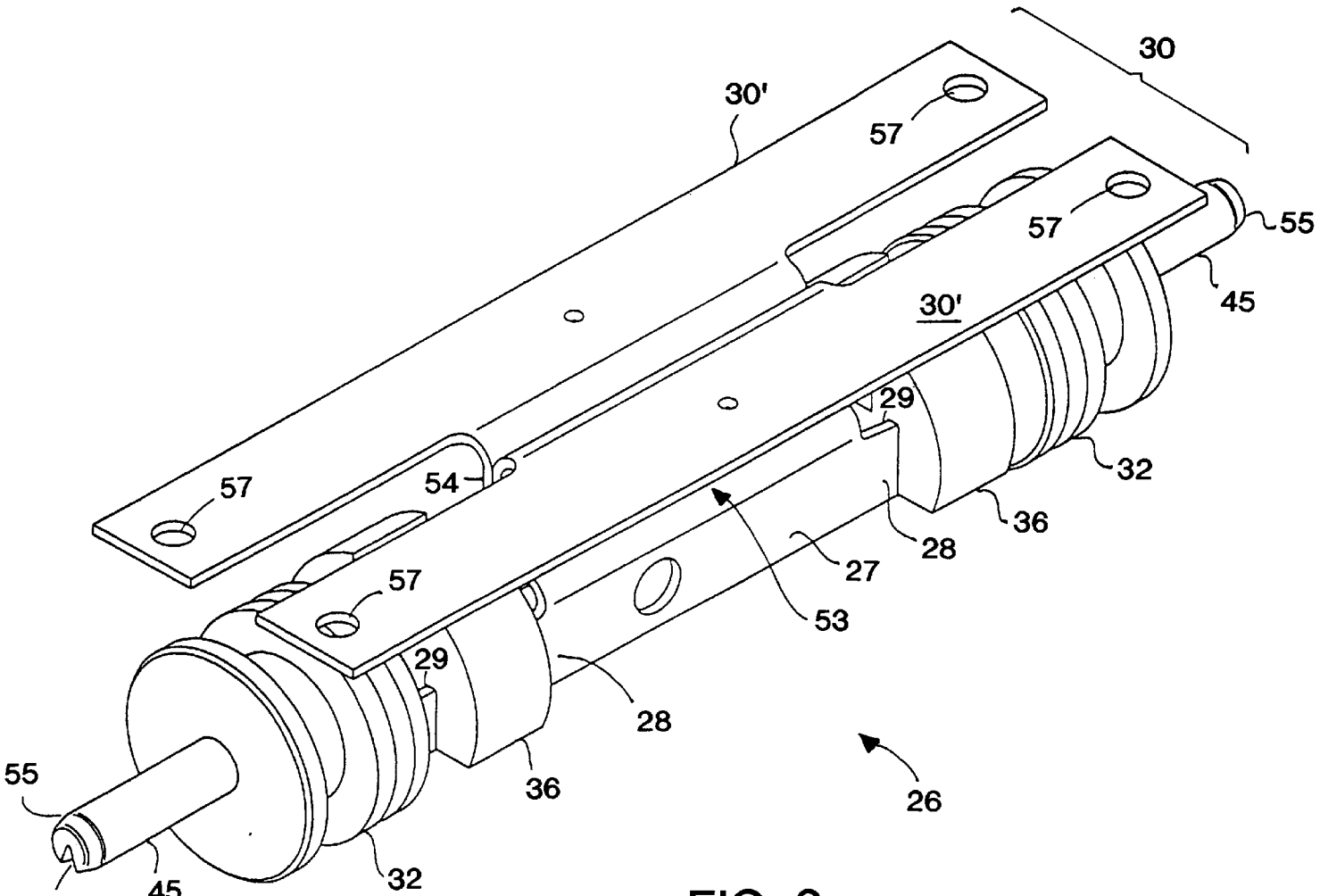
FIG. 3 is a perspective view of a piston assembly according to one embodiment of the present invention.

The rodless cylinder assembly includes a piston assembly (FIG. 3) which is positioned within cylindrical bore 22 and includes a structure which extends through slot 23. The piston assembly 26 includes a transmission bracket 27 which, as depicted in the embodiment of FIG. 2 in made from two portions 27' that can be attached together as depicted in FIG. 3. When the rodless piston assembly is assembled, the lower portion of the transmission bracket which defines the side members 28 and rails 29 as identified below reside within the cylindrical bore 22. The upper portion of the transmission bracket 27 which defines the mounting plate 30 as identified below is located adjacent the outer wall surface 31 of the elongate cylinder body 20 which surface 31 has the slot 23 formed therein. The central portion of the transmission bracket 27 defines a narrow portion which extends through slot 23.

The piston assembly includes piston elements 32 which are attached to the ends of the transmission bracket 27 as discussed below. Piston seal members 33 are provided which can be secured to the peripheral surface of the piston elements 32 in a conventional manner. The piston seal elements 33 depicted in FIG. 2 are provided with notched-out portions 34 which conform to the cross sectional shape of lower or inner band member 35.

Internal bearing members 36 are positioned on the transmission bracket 27 behind the piston elements 32 as depicted. The internal bearing members 36 are provided with a pair of parallel lower slots 37 for receiving the rails 29 of the transmission bracket 27 as discussed below, and a centrally located inclined upper slot 38 which is provided to allow lower or inner band member 35 to slide therethrough.

FIG. 2 also depicts an external bearing assembly 39 and a saddle 40 which is designed to be secured to the upper portion or mounting plate 30 of the transmission bracket 27 and external bearing assembly 40 by threaded members, e.g. bolts 41 and nuts 42. Also shown in FIG. 2 are seal members, e.g., o-rings 43 which are used to seal the head assemblies 21 onto the ends of the elongate cylindrical body 20, and the snout seals 44 which provide a seal between piston cushion studs 45 and snouts 46 located in the head assemblies 21. In addition, FIG. 2 shows band clamp plate 47 and blocker 48 which are used to secure the ends of band members 35 and 49 in place. The band clamp plate 47 is secured in position by threaded members 50. FIG. 2 also includes oil wicks 51 which are positioned adjacent piston elements 32.

Outward motion of the piston elements 32 is arrested by having the piston cushion studs 45 enter the snouts 46 in the head assemblies 21. Fluid pressure trapped by the piston cushion studs 45 controls deceleration of the piston elements 32 and prevents bouncing of the piston elements 32. Valve elements 52 are provided in the head assemblies 21 and used to meter release of fluid pressure that is trapped in the snouts 46 by the piston cushion studs 45. According to one embodiment of the present invention, the piston cushion studs 45 are sufficiently tapered along a substantial portion of their length to control the release of fluid trapped in the snouts of the head assemblies.

FIG. 3 is a perspective view of a piston assembly according to one embodiment of the present invention. The piston assembly generally identified by reference numeral 26 includes transmission bracket 27 (shown with the two half portions 27' of FIG. 2 attached together), internal bearing members 36 and piston elements 32. The transmission bracket 27 as depicted in FIG. 3 includes a pair of parallel elongated side members 28 which define a pair of rails 29 upon which the internal bearing members 36 are received. In this regard, the lower pair of slots 37 in the internal bearing members 36 are configured so that the internal bearing members 36 can be seated in a sliding manner on the rails 29. That is, so that the rails 29 are received in the lower parallel slots 37 of the internal bearing members 36.

The transmission bracket 27 includes a mounting bracket 53 which extends in a radial direction with respect the longitudinal axis of the transmission bracket. The mounting bracket 53 includes a narrow portion 54 which is sized to be received in and extend though slot 23. The mounting bracket 53 includes a mounting plate 30 to which a saddle 39 can be coupled as discussed herein. The mounting plate 30 is defined by the two upper portions 30' of the transmission bracket 27 which are depicted in FIG. 2.

The piston elements 32 are depicted as being coupled to the ends of the transmission bracket 27. In the embodiment depicted, the piston elements 32 include piston cushion studs 45 which extend outwardly from the transmission bracket 27. These piston cushion studs 45 are depicted as having a beveled end 55 and a V-shaped notch 56 at the end. When the piston cushion stud 45 is driven into the snout 46 in its respective head assembly 21, the V-shaped notch 56 allows trapped fluid to escape at a controlled rate which thereby slowing the piston element 32 to a stop. In an alternative embodiment, the piston cushion stud 45 could be provided with an elongated tapered portion in place of the beveled end 55, which elongated tapered portion would control the escape of trapped fluid and slow the piston element 32 to a stop.

The transmission bracket 27 can be fabricated from two metal half members or portions 27' by fastening the portions together at the mounting bracket 53 as depicted (or else where). Alternatively, the transmission bracket 27 can be formed as an integral structure. The mounting plate 30 is depicted as having a rectangular upper surface with a plurality of mounting holes 57. From the following description, it is to be understood that the mounting plate 30 can have other configurations that will be compatible with other carriage and/or saddle designs.

Figure 4:
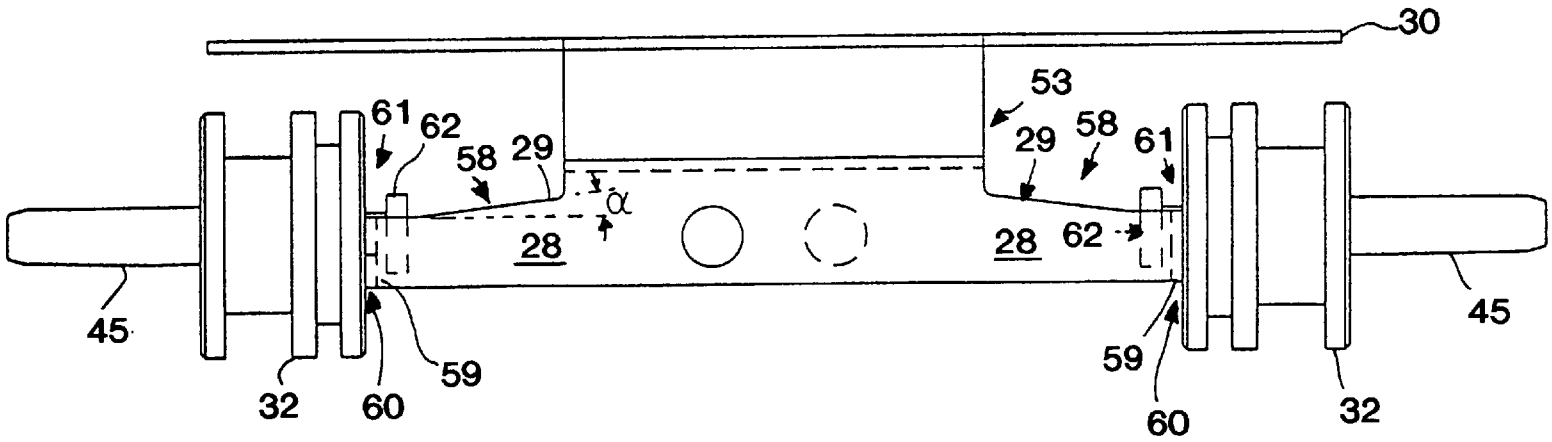
FIG. 4 is a side view of the transmission bracket of FIG. 3.

FIG. 4 is a side view of the transmission bracket of FIG. 3. The transmission bracket 27 in FIG. 4 does not have the internal bearing members 36 positioned on the rails 29 thereof. As depicted, the upper portions of the rails 29 include a slightly inclined or slopped portion 58 which slopes downward in the direction away from the center of the bracket.

The upper ends of the rails 29 are slightly inclined, e.g. approximately 3° to 6° as indicated by angle "∀" in FIG. 4. When the internal bearing members 32 are positioned on the inclined portions 58 of the rails 29, movement of the internal bearing members 36 inward toward the center of the transmission bracket 27 causes the internal bearing members 36 to slide upward along the inclined portions 58 of the rails 29. This upward movement of the internal bearing members 36, as discussed in detail below causes the transmission bracket 27 to be forced downward. According to the present invention, this downward force applied to the transmission bracket 27 is transferred to a saddle 39 which is coupled to the transmission bracket 27 by the mounting plate 30.

Figure 5:
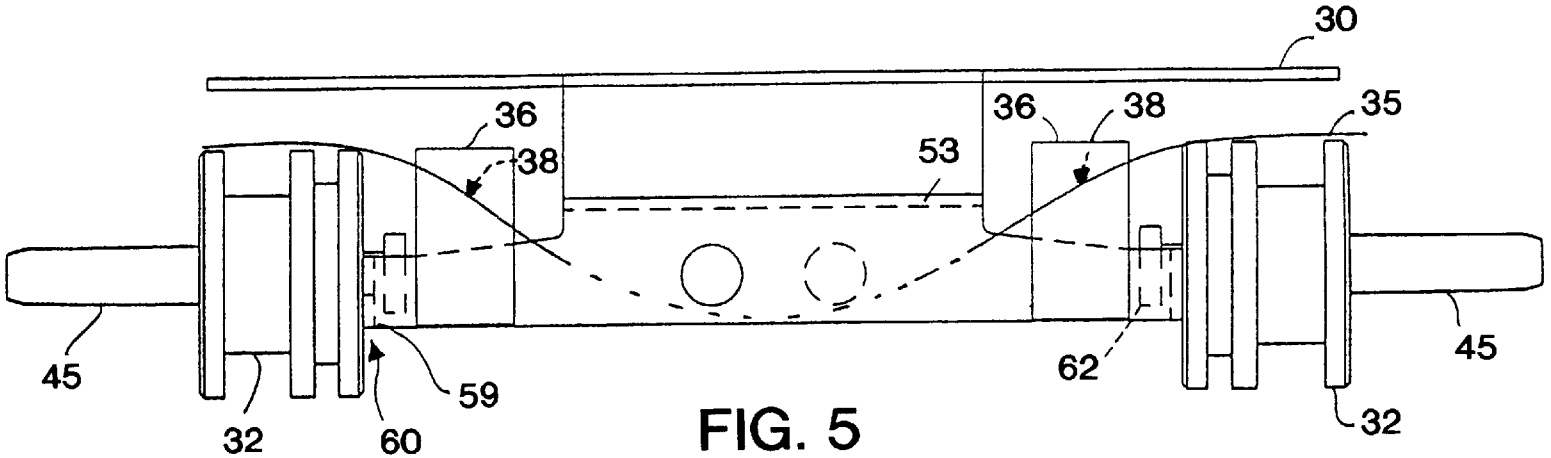
FIG. 5 is a side view of the transmission bracket of FIG. 4 which includes the internal bearings.

FIG. 5 is a side view of the transmission bracket of FIG. 4 which includes the internal bearing members. FIG. 5 depicts how upper inclined slots 38 in the internal bearing members 36 are aligned so that the inner band member 35 can slide through inclined slots 38 and beneath mounting bracket 53 and between parallel elongate side members 28. FIG. 5 further depicts how the base of the lower pair of parallel slots 37 of the internal bearing members 36 are inclined complementarily with the inclined portions 58 of the rails 29 so as to ensure that the internal bearing members 36 are aligned with the piston elements 32 and the inner surface of the cylindrical bore 22 of the elongate cylinder body 20.

Each of FIGS. 4 and 5 depict how the piston elements 32 are coupled to the transmission bracket 27 according to one embodiment of the present invention. As depicted in FIG. 2, the side members 28 of the transmission bracket 27 include inwardly directed end portions 59 which (when the transmission bracket 27 is assembled) define slots 60 which are located at each end of the transmission bracket 27 (See FIG. 2). The piston elements 32 each include a projection 61 that is configured to be received and retained in the slots 60 of the transmission bracket 27 as depicted. In addition, projections 61 include head portions 62 which serve to abut against a spring member 63 that is depicted in FIG. 6.

Figure 6:
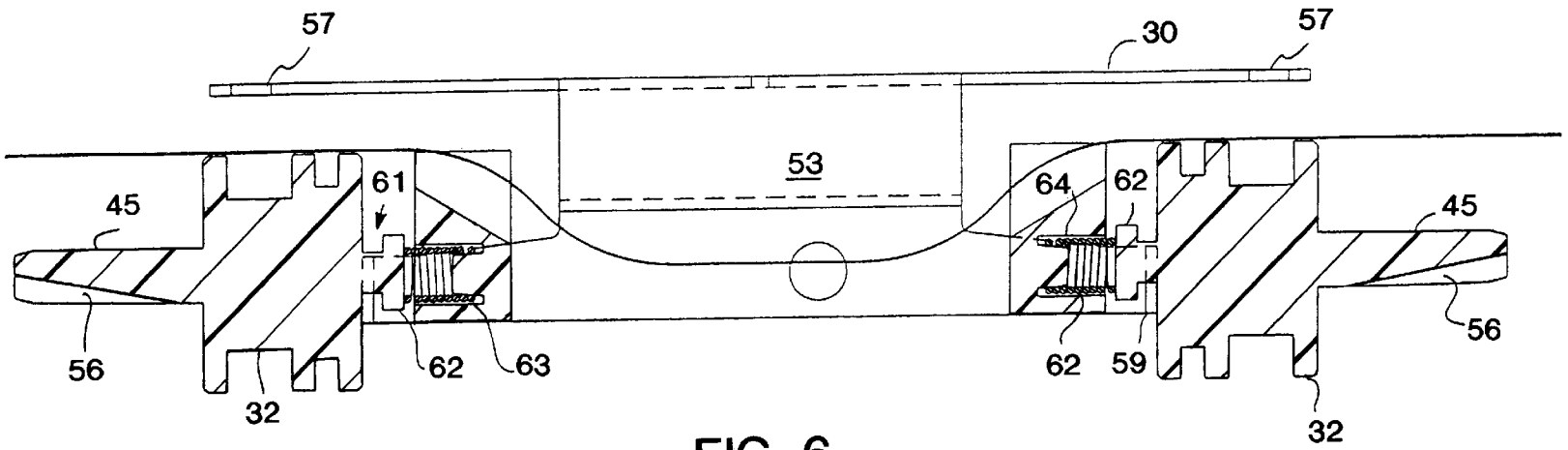
FIG. 6 is a cross sectional view of a piston assembly which includes spring members that urge the internal bearing members toward the center of the transmission bracket.

FIG. 6 is a cross sectional view of a piston assembly which includes spring members 63 that urge the internal bearing members 36 toward the center of the transmission bracket 27, and thus up along inclined portion 58 of the rails 29. The spring members 63 are depicted as be positioned between the head portions 62 of piston projections 61 and the bottom of a shallow bore formed in a face of the internal bearing members 36. These spring members 63 are provided to urge the internal bearing members 36 toward the center of the transmission bracket 27 so that they press against the upper inner surface of the cylindrical bore 22. It is noted that the spring members 63 are depicted as being depressed by the piston elements 32. In actual use, the spring members 63 would tend to push the piston elements 32 outward, absent any fluid pressure acting on the piston elements 32. The projections 61 also couples the piston elements 32 to the transmission bracket 27. Absent such coupling, it would be possible for the piston elements 32 to become separated and spaced apart from the transmission bracket 27. If fluid pressure were applied during such separation, it is possible for the piston elements 32 to slam into the transmission bracket 27 become damaged.

It is noted that the manner in which the piston elements 32 are coupled to the transmission bracket 27 allows the piston elements 32 to "float" within the cylindrical bore 22. That is, the piston elements 32 are movably coupled to the transmission bracket 27 so that they are allowed to self-adjust into alignment with the cylindrical bore 22 of the piston elongate cylinder body 20. In this regard, it is noted that piston elements 32 are only coupled to the ends of the transmission bracket 27 in a manner which generally restrains their longitudinal axial movement with respect to the transmission bracket 27. The piston elements 32 are otherwise able to move with respect to the transmission bracket 27 so that there respective central axes can be aligned or displaced from one another.

Figure 7:
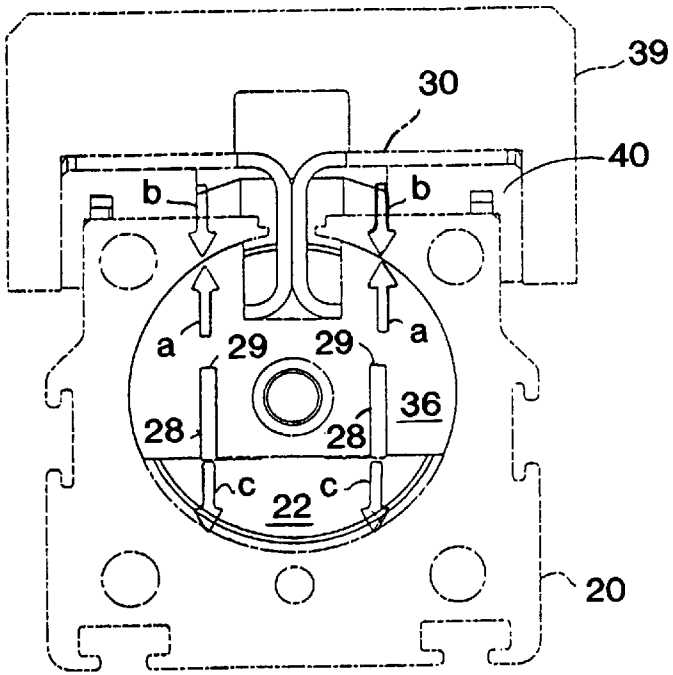
FIG. 7 is schematic axial cross sectional view of a rodless cylinder assembly according to the present invention taken though one of the internal bearing members which depicts the forces acting on the elements.

FIG. 7 is schematic axial cross sectional view of a rodless cylinder according to the present invention taken though one of the internal bearing members which depicts the forces acting on the elements. As each of the internal bearing members 36 slides along the rails 29 toward the center of the transmission bracket 27 (into the page in FIG. 7)it moves up the inclined portions 58 of the rails 29 and is pressed against the upper inner surface of the cylindrical bore 22. Forces exerted between the internal bearing member 36 and the inner surface of the elongate cylindrical body 20 as indicated by arrows "a" and "b" create a resultant force which pushes the transmission bracket 27 downward as indicated by arrow "c" in FIG. 7.

Figure 8:
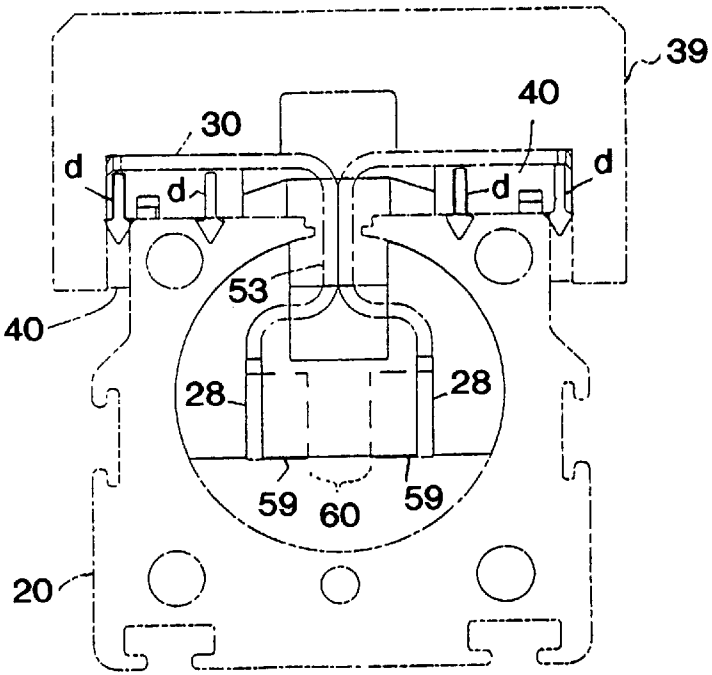
FIG. 8 is schematic axial cross sectional view of a rodless cylinder assembly according to the present invention taken though the center of the transmission bracket which depicts the forces acting on the elements.

FIG. 8 is schematic axial cross sectional view of a rodless cylinder assembly according to the present invention taken though the center of the transmission bracket which depicts the forces acting on the elements. The force represented by arrow "c" in FIG. 7 which acts upon the transmission bracket 27 when the internal bearing member 36 slides along the inclined portions of the rails and pushes against the inner surface of the cylindrical bore 22 is transmitted through the mounting bracket 53 and mounting plate 30. As indicated by arrows "d" in FIG. 8, the mounting plate 30 distributes the downward force to saddle 39 which applies the downward force to an external bearing assembly 40 which is provided between the upper surface 31 of the elongate cylinder body 20 and the saddle 39.

The downward force which essentially pulls saddle 39 downward against surface 31 of the elongate cylinder body 20 maintains the radial position and alignment of the saddle 39 with respect to the axis of the elongate cylinder body 20. Thus, the use of the internal bearing member 36 according to the present invention eliminates the need for external structural elements to secure the saddle 39 and elongate cylinder body 20 together. As depicted in FIG. 8, the saddle 39 and/or external bearing assembly 40 can include arm portions 65 which extend over sides 66 of the elongate cylindrical body 20 which are adjacent surface 31 thereof. These arm portions 65 can be provided to maintain the axial position and alignment of the saddle 39 (and external bearing assembly 40) with respect to the axis of the elongate cylinder body 20.

Figure 9:
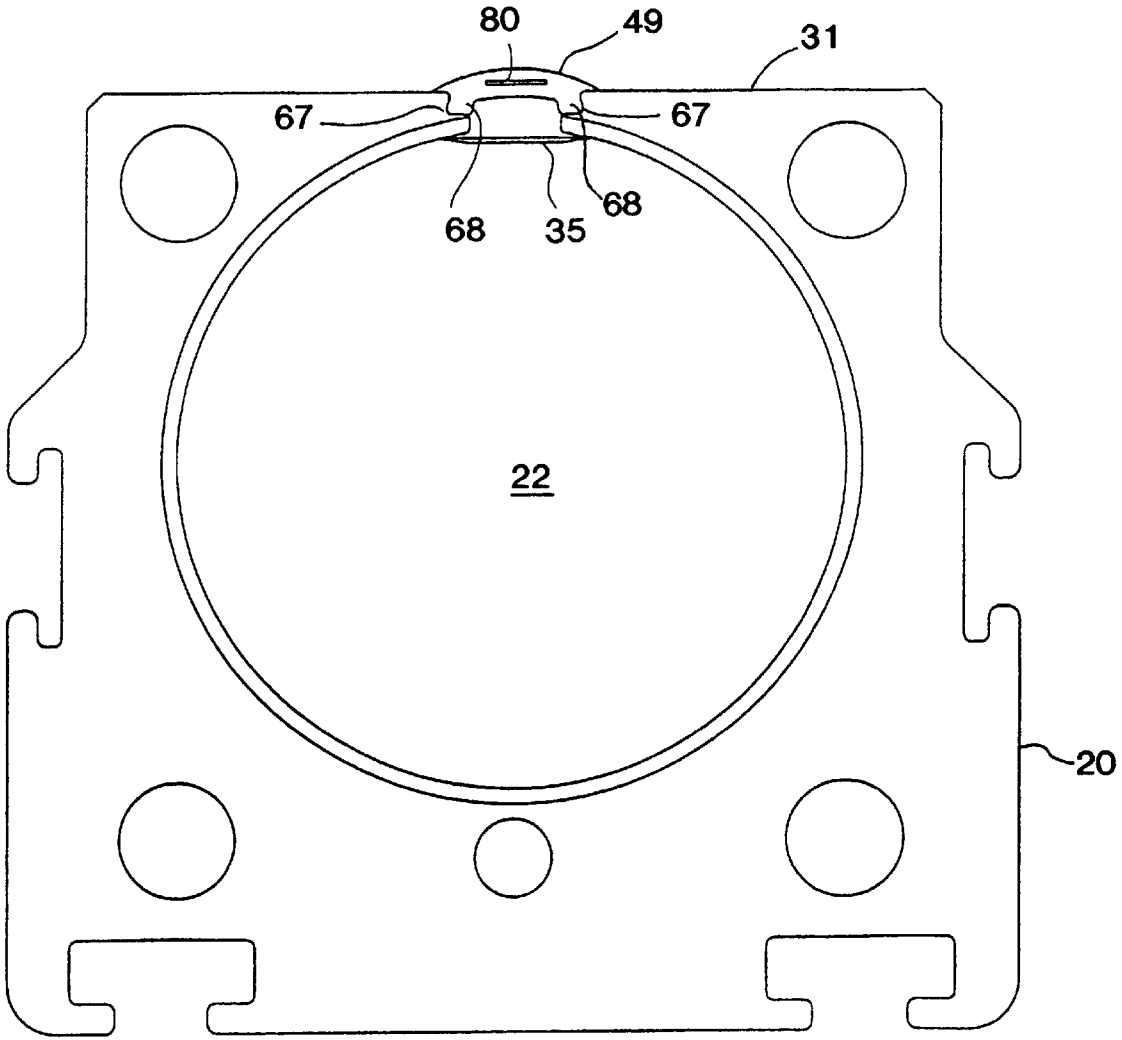
FIG. 9 is an axial cross sectional view of an elongate cylindrical body and the outer and inner band members according to one embodiment of the present invention.

FIG. 9 is an axial cross sectional view of the elongate cylindrical assembly and the inner and outer band members according to one embodiment of the present invention. As depicted, slot 23 is provided with undercut edge portions 67 along the length thereof where slot 23 intersects surface 31 of the elongate cylinder body 20. As shown in the cross sectional view, the outer band member 49 is provided with leg portions 68 which are complementarily shaped with the undercut edge portions 67 of the slot 23 to the extent that the outer band member can be readily pulled or stripped out of slot 23 and pushed back in slot 23 as the piston assembly 26, external bearing assembly 40 and saddle 39 move in a reciprocal manner. The outer band member 49 includes an inner metal member 80 which extends along the length thereof. Metal member 80 assists in extruding the upper band member 49 and strengthens the upper band member 49 so that the leg portions 68 extend outward as depicted for being receivable in undercut edge portions 67.

The inner band member 35 is also depicted in cross section in FIG. 9. The inner band member 35 has a substantially planar lower surface which interrupts the circular cross sectional shape of cylindrical bore 22. As depicted in FIG. 2, the piston seals 33 are provided with a cutout or notched portion 34 which is complementarily shaped to cross sectional shape of the cylindrical bore 22 as interrupted by the inner band member 35.

Figure 10:
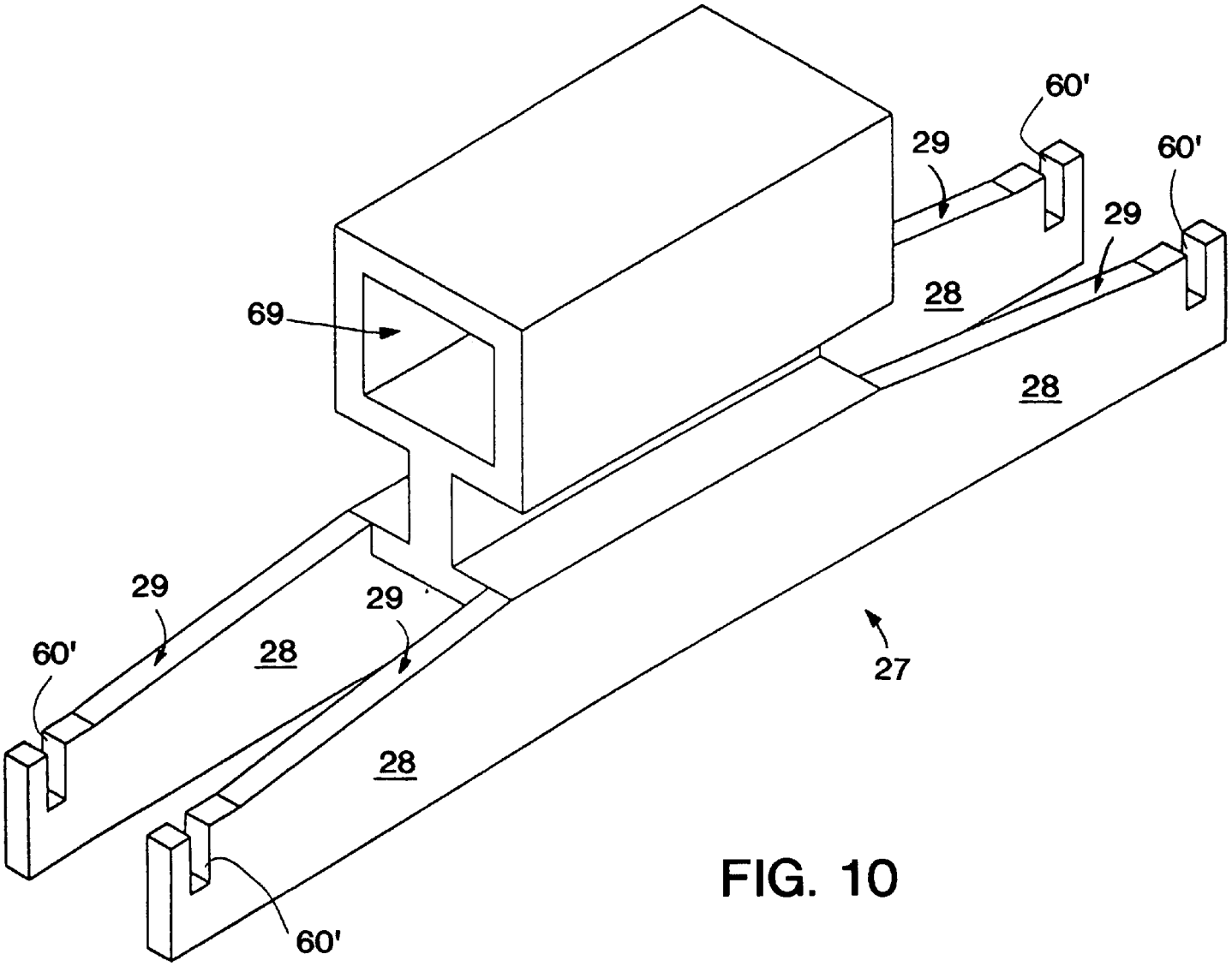
FIG. 10 is perspective view of the transmission bracket according to another embodiment of the present invention.

FIG. 10 is perspective view of the transmission bracket according to another embodiment of the present invention. The transmission bracket 27 depicted in FIG. 10 includes open slots 60' which are formed in the side members 28 near the ends thereof. These open slots 60' are depicted as intersecting the rail 29 upon which the internal bearing members 36 slide. These open slots 60' are provided to couple the piston elements 32 to the piston transmission bracket 27. In this regard, the piston elements 32 can be provided with a projection similar to that depicted in FIG. 4 (projection 61) which is configured to be received and retained in the open slots 60' of the transmission bracket 27. It is to be understood that the ends of the side members 28 could include other structure for coupling the piston elements 32 to the transmission bracket 27.

The transmission bracket 27 depicted in FIG. 10 also includes structure which defines an upper channel 69 which is designed to allow the upper band member 49 to pass therethrough when the piston assembly 26 moves reciprocally along the elongate cylinder body 20.

Figure 11:
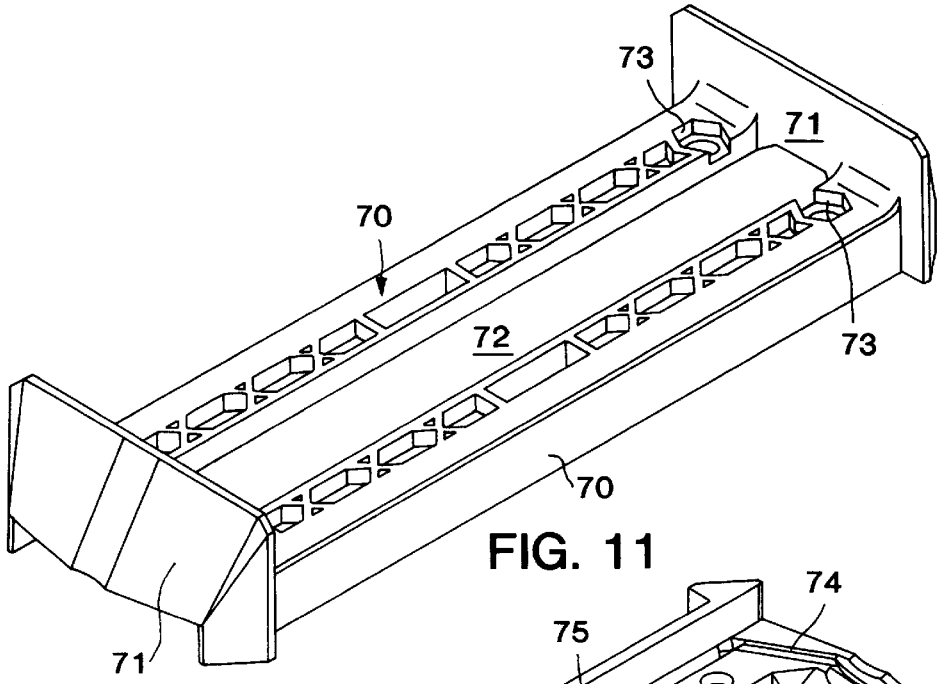
FIG. 11 is a perspective top view of the external bearing assembly according to one embodiment of the present invention.

FIG. 11 is a perspective view of the external bearing assembly according to one embodiment of the present invention. FIG. 11 depicts the external bearing assembly 40 in perspective from a top view point. The external bearing assembly 40 includes parallel side members 70 which define external bearing surfaces (see FIG. 13) and end portions 71 which couple the parallel side members 70 together. The external bearing assembly 40 includes a open central portion 72. As can be seen from FIG. 2, the open central portion 72 allows for assembly of the rodless cylinder. In this regard, the lower portion (parallel side members 28 and mounting bracket 53) of the transmission bracket 27 can be inserted through the opening in the open central portion 72 in the external bearing assembly 40 so that the mounting plate 30 rests on the upper surface of the parallel side members 28. As discussed above, the forces exerted on the internal bearings "pulls" the transmission bracket 27 (and external bearing assembly 40) radially inward toward the axial center of the rodless elongate cylinder body 20.

The saddle 39 (FIG. 2) can be coupled to the mounting plate 30 of the transmission bracket 27 by any convenient means. For example, in the embodiment of the external bearing assembly depicted in FIG. 11, counter-sunk bores 73 are provided in the upper surface of the parallel side members 28. These counter-sunk bores 73 are configured to receive internally threaded nuts 42 (FIG. 2). Threaded bolts 41 (FIG. 2) can be used together with threaded nuts 42 to couple the saddle 39 to the mounting plate 30 as depicted in FIG. 2.

Figure 12:
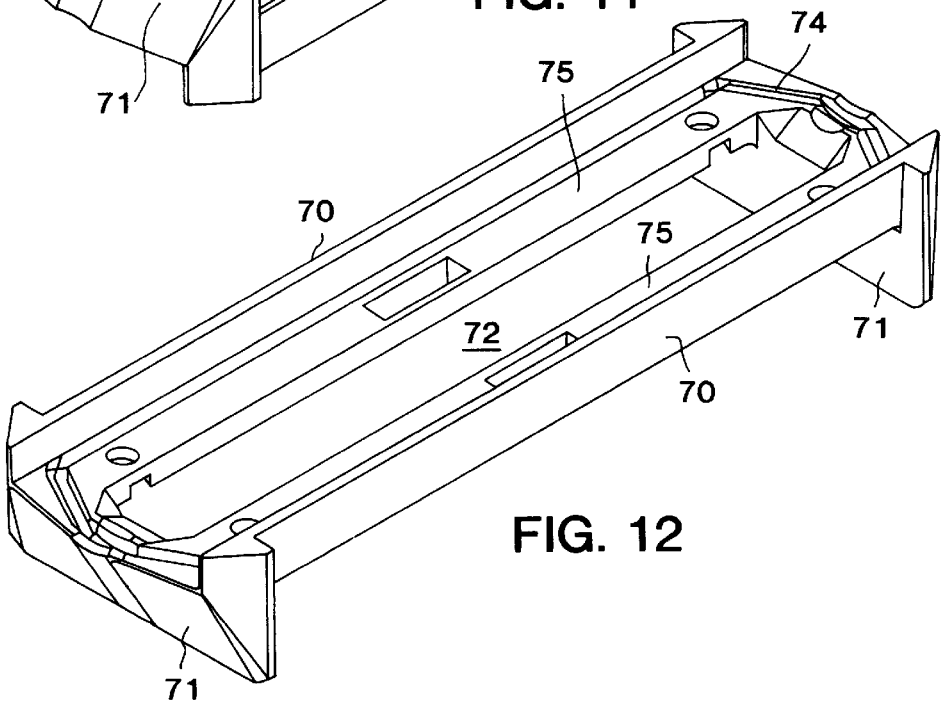
FIG. 12 is a perspective bottom view of the external bearing assembly of FIG. 11.

FIG. 12 is a perspective bottom view of the external bearing assembly of FIG. 11. As depicted, the external bearing assembly 40 can be provided with a sealing member (not shown) that can be inserted in a seal member groove 74 which extends along a peripheral portion of the lower bearing surfaces 75. The use of such an optional sealing member (e.g. o-ring), may be desired to protect the piston assembly and other elements "covered" by the bearing assembly 40, from dust, dirt, fluids, etc. It is noted that the end portions 71 of the external bearing assembly 40 can be tapered outwardly toward the ends of the elongate cylinder body 20 for purposes of clearing the upper surface 31 of the elongate cylinder body 20 as the external bearing assembly 40 moves reciprocally along surface 31.

Figure 13:
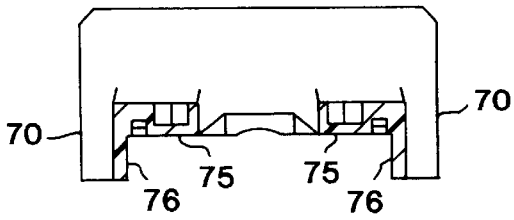
FIG. 13 is a cross sectional view of the external bearing assembly.

FIG. 13 is a cross sectional view of the external bearing assembly. FIG. 13 shows the lower bearing surfaces 75 which are designed to slide along slotted surface 31 of the elongate cylinder body 20 and the side bearing surfaces 76 which are designed to slide along the adjacent side surfaces 66 of the elongate cylinder body 20.

The use of the internal bearing members 36 in the rodless cylinder of the present invention provides constant adjustment of the external bearing assembly 40. That is, even as bearing surfaces 75 wear, the force exerted on the external bearing assembly 40 remains constant due to the manner in which the internal bearing members 36 interact with the inclined portions 58 of the rails 29 and with the inner surface of the cylindrical bore 22.

Although the present invention has been described with reference to particular means, materials and embodiments, from the foregoing description, one skilled in the art can easily ascertain the essential characteristics of the present invention and various changes and modifications may be made to adapt the various uses and characteristics without departing from the spirit and scope of the present invention as set forth in the following claims.

What is claimed is:

1. A rodless cylinder which comprises:

a cylinder having opposed ends and a longitudinal slot; and a piston assembly located in the cylinder for reciprocating movement therein, the piston assembly including:

a transmission bracket located partially in the cylinder and having a mounting plate which extends through the longitudinal slot for reciprocating movement along an outer surface of the cylinder, and a pair of elongate side members, said pair of elongate side members including inclined surfaces; and internal bearing members located in the cylinder which rest on the inclined surfaces of the elongate side members so as to freely slide thereon.

2. The rodless cylinder according to claim 1, wherein the inclined surfaces of the pair of elongate side members define rails upon which the internal bearing members rest.

3. The rodless cylinder according to claim 1, further comprising means to urge the internal bearing members along and up the inclined surfaces of the pair of elongate members.

4. The rodless cylinder according to claim 3, wherein the means to urge the internal bearings comprises spring members.

5. The rodless cylinder according to claim 4, further including piston elements which are coupled to opposite ends of the pair of elongate members.

6. The rodless cylinder according to claim 5, wherein the spring members are positioned between the internal bearing members and the piston elements.

7. The rodless cylinder according to claim 6, wherein the pair of elongate members include slots in which the piston elements are coupled.

8. The rodless cylinder according to claim 7, wherein the piston elements are movable in the slots, whereby relative axial alignment of the pair of elongate members and the piston elements can vary.

9. The rodless cylinder according to claim 1, wherein the transmission bracket includes a mounting bracket and a mounting plate.

10. The rodless cylinder according to claim 1, wherein the internal bearing members include cutout portions which allow a sealing band to pass therethrough.

11. A rodless cylinder which comprises:

a cylinder having opposed ends and a longitudinal slot; and a piston assembly including:

a transmission bracket located partially in the cylinder and having a central axis, opposite end portions and a mounting plate which extend through the longitudinal slot for reciprocating movement along an outer surface of the cylinder; and a pair of piston elements located in the cylinder and being movably coupled to the end portions of the transmission bracket, whereby relative axial alignment of the piston elements can vary with respect to the central axis of the transmission bracket.

12. The rodless cylinder according to claim 11, wherein the transmission bracket and the pair of piston elements are movably coupled together by cooperating slots and projection structures.

13. The rodless cylinder according to claim 12, wherein the slots are provided in a portion of the transmission bracket and the pair of piston elements include the projection structures.

14. The rodless cylinder according to claim 11, wherein the transmission bracket includes a mounting bracket and a mounting plate.

15. A rodless piston assembly which comprises:

an elongate piston cylinder having an axis, a slot formed in a first side thereof and an internal bore;

a transmission bracket which is positioned in the internal bore of the elongate piston cylinder and includes a mounting bracket that extends through the slot for reciprocating movement along an outer surface of the elongate piston cylinder;

internal bearing members which are positioned in the internal bore of the elongate piston cylinder and are operably coupled to the transmission bracket so as to exert a radial force on the mounting bracket.

16. The rodless piston assembly according to claim 15, wherein the transmission bracket includes a pair of elongate members having inclined upper surfaces adjacent opposite ends thereof, and the internal bearings members are provided with slots which receive the inclined upper surfaces of the elongate members.

17. The rodless piston assembly according to claim 15, further comprising means to urge the internal bearing members along and up the inclined upper surfaces of the pair of elongate members.

18. The rodless piston assembly according to claim 17, wherein the means to urge the internal bearings comprises spring members.

19. The rodless piston assembly according to claim 15, further including piston elements which are coupled to opposite ends of the pair of elongate members.

20. The rodless piston assembly according to claim 19, wherein the pair of elongate members include slots in which the piston elements are coupled.

21. The rodless piston assembly according to claim 15, further comprising an external bearing assembly coupled to the transmission bracket.

22. The rodless piston assembly according to claim 21, further comprising a saddle coupled to the external bearing assembly.

23. A method of coupling a saddle to a rodless cylinder assembly which comprises:

providing a rodless cylinder which includes:

an elongate piston cylinder having an axis, a longitudinal slot formed in a first side thereof and an internal bore; and a piston assembly located in the elongated cylinder, the piston assembly including:

a transmission bracket positioned in the internal bore of the elongate piston cylinder and including a mounting bracket that extends through the slot for reciprocating movement along an outer surface ofthe elongate piston cylinder;

positioning an internal bearing member in the internal bore of the elongate piston cylinder;

operably coupling the internal bearing to the transmission bracket so that radial forces are exerted on the mounting bracket when the internal bearing moves axially with respect to the transmission bracket; and coupling a saddle to the mounting bracket.

24. The method of coupling a saddle to a rodless cylinder assembly according to claim 23, further comprising providing an external bearing assembly between the saddle and elongate piston cylinder.

25. The method of coupling a saddle to a rodless cylinder assembly according to claim 24, further comprising providing the bearing assembly with lower and side bearing surfaces.

* * * * *